US006178571B1

(12) United States Patent
McAllister

(10) Patent No.: US 6,178,571 B1
(45) Date of Patent: Jan. 30, 2001

(54) BARRIER-FREE SHOWER SYSTEM

(75) Inventor: George F McAllister, Franklin, TN (US)

(73) Assignee: Aqua Bath, Inc., Nashville, TN (US)

( * ) Notice: Under 35 U.S.C. 154(b), the term of this patent shall be extended for 0 days.

(21) Appl. No.: 09/450,895

(22) Filed: Nov. 29, 1999

Related U.S. Application Data

(63) Continuation-in-part of application No. 09/273,811, filed on Mar. 19, 1999, which is a continuation of application No. 09/073,650, filed on May 6, 1998, now abandoned, and a continuation-in-part of application No. 09/073,535, filed on May 6, 1998.

(60) Provisional application No. 60/046,091, filed on May 9, 1997.

(51) Int. Cl.[7] ..... A47K 3/40; A47K 3/38

(52) U.S. Cl. ..... 4/613; 4/608

(58) Field of Search ..... 4/558, 608, 604, 4/612, 613

(56) References Cited

U.S. PATENT DOCUMENTS

| | | |
|---|---|---|
| D. 298,103 | 10/1988 | Rose . |
| 2,212,326 | 8/1940 | Piken . |
| 2,449,323 | 9/1948 | Richterkessing . |
| 3,004,769 | 10/1961 | Turner . |
| 3,107,361 | 10/1963 | Glutting . |
| 3,483,494 | 12/1969 | Cromie . |
| 4,723,326 | 2/1988 | Tarlow et al. . |
| 5,243,716 | 9/1993 | Zaccai et al. . |
| 5,279,100 | 1/1994 | Pruitt et al. . |
| 5,421,393 | 6/1995 | Wolfe et al. . |
| 5,718,008 | 2/1998 | Pane . |

*Primary Examiner*—Charles E. Phillips
(74) *Attorney, Agent, or Firm*—B. Craig Killough

(57) ABSTRACT

A barrier-free shower system having the combined configuration of a drain sump, drain and a continuously weighted shower curtain. A series of channels is formed into a threshold of a barrier free shower enclosure. The channels trap water within the shower enclosure and channel the water toward the drain sump. Water is directed to the channels from the base of the shower enclosure and from a shower curtain which hangs directly over the threshold. There is no lip or barrier in the base of the shower at the threshold to keep the curtain from billowing out as heat escapes the shower enclosure, so a continuous weight is provided near a lower edge of the curtain to keep it positioned over the channels in the threshold.

12 Claims, 6 Drawing Sheets

BARRIER-FREE SHOWER SYSTEM

This application is a continuation-in-part of pending application Ser. No. 09,273,811, filed Mar. 19, 1999, which is a continuation of Ser. No. 09,073,650, filed May 6, 1998, now abandoned, and a continuation-in-part of pending application Ser. No. 09,073,535, filed May 6,1998, which claims priority of provisional application 60/046,091, filed May 9,1997.

TECHNICAL FIELD

This invention relates to shower and shower enclosures generally, and is more particularly directed to a base for a barrier-free shower enclosure and a shower curtain system which, acting in concert, inhibit water from escaping through the barrier-free entrance to the shower enclosure.

BACKGROUND OF THE INVENTION

So-called barrier-free shower enclosures have, at their entrance, no raised portion or lip. The advantage and purpose of such a configuration is to enable a person in a wheelchair to enter or be easily wheeled into the enclosure. The disadvantage of a such a configuration is that no barrier exists to prevent water from running out over the base at the entrance and onto the floor adjoining the enclosure. Barrier-free showers are in common use in nursing homes, hospitals, and other care facilities. Barrier-free showers allow a wheelchair to be positioned within the shower, so that the occupant can bathe.

Barrier-free showers are in increasing use. As the population ages, more and more people will become confined to wheelchairs. The demand for, and use of, barrier-free showers is rising.

As the "barrier free" designation suggests, at least one side or wall of the shower has a large opening to allow ingress and egress of a wheelchair. The floor adjoining the opening at the threshold is relatively flat, with no obstructions, to allow movement of a wheel chair over the threshold and into the shower.

Because there is no barrier on the entry side of the shower, there is nothing to prevent water from running out of the shower and onto the floor area which is in proximity to the shower. Water on the floor is a major safety and housekeeping problem which is experienced with all barrier-free showers, and in all facilities which use barrier-free showers.

The intermittent attachment of weights to the bottom of a curtain of flexible material, whether that curtain be of decorative or utilitarian function, is known to keep the curtain extended from its top portion, which is attached to a curtain or shower rod, or similar support, toward the floor or the bottom of a tub or the base portion of a shower enclosure. Early weighting devices were coins or similarly formed segments of metal sewn into the hem of a drapery. Shower curtains were also weighted with discrete metal segments, sometimes magnetized, sealed into the lower of the curtain for adherence to a metal tub. U.S. Pat. No. 4,723,326 to Tarlow et. al. discloses one such weighted shower curtain.

These prior art devices were not designed for barrier free shower designs. While intermittent or interval weighting systems have been used, they do not adequately keep the curtain in place when used with a barrier free showers. The curtain will billow between weights, allowing the water striking the curtain to channel within the billows, and run out on the floor.

Traditional shower bases have a centrally located drain hole, usually with the base, on all surfaces, angled downwardly towards the drain. When there is a front barrier in the form of either a shower curtain, or a rigid sliding shower door, water exiting the shower head, or splashed within the enclosure runs down the walls of the enclosure, and down the curtain or door. The water is thereby channeled toward the drain located in the base or floor of the enclosure. With a barrier-free configuration, this structure works on three of the four sides, but not on the fourth side, which is the entrance side of the barrier free enclosure.

SUMMARY OF THE INVENTION

The present invention is a barrier-free shower enclosure system having a drain sump and drain. A series of channels is formed into the base of the shower enclosure at the threshold. The channels collect water and channel the water toward the drain sump. A continuously weighted shower curtain, which will not billow out from heat escaping the shower, is positioned over the threshold, which is formed according to the invention.

The channels are formed adjacent to opening, or entrance side, of the enclosure. The shower curtain acts in concert with the base to effectively prevent water from leaking out of a barrier-free shower enclosure.

Accordingly, it is an object of the invention to provide a shower curtain that has a continuous weighing device at or near its bottom edge, so that it will hold the curtain within the barrier-free (i.e. having no barrier across its front entrance) base for a shower enclosure, which will collect and drain the water away from the entrance to the shower, and keep the water off of areas of the floor which should be kept dry. It is another object of this invention to present a configuration of a drain sump, drain, and channels that inhibit the water from escaping the opening of a barrier-free shower enclosure, and in combination with a continuously weighted shower curtain, inhibit water from escaping the opening of a barrier-free shower enclosure.

DESCRIPTION OF THE PREFERRED EMBODIMENT

In the description of the following figures, like numbers refer to like features.

Figure 1:
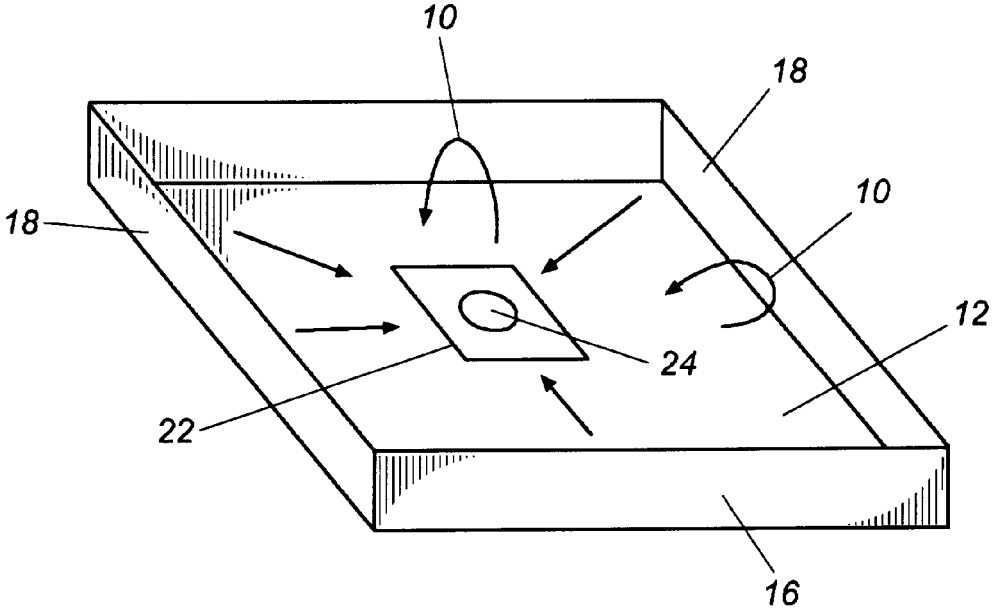
FIG. 1 demonstrates the water flow in a traditionally configured shower base.

As shown in FIG. 1, water, indicated by arrows 10, is reaching the base of a traditionally configured shower enclosure 12 having a front, partial lip or barrier 16. The water is deflected from the sides 18 and back 20 toward drain sump 22 and drain 24 which is centrally located within the shower base 26.

Figure 2:
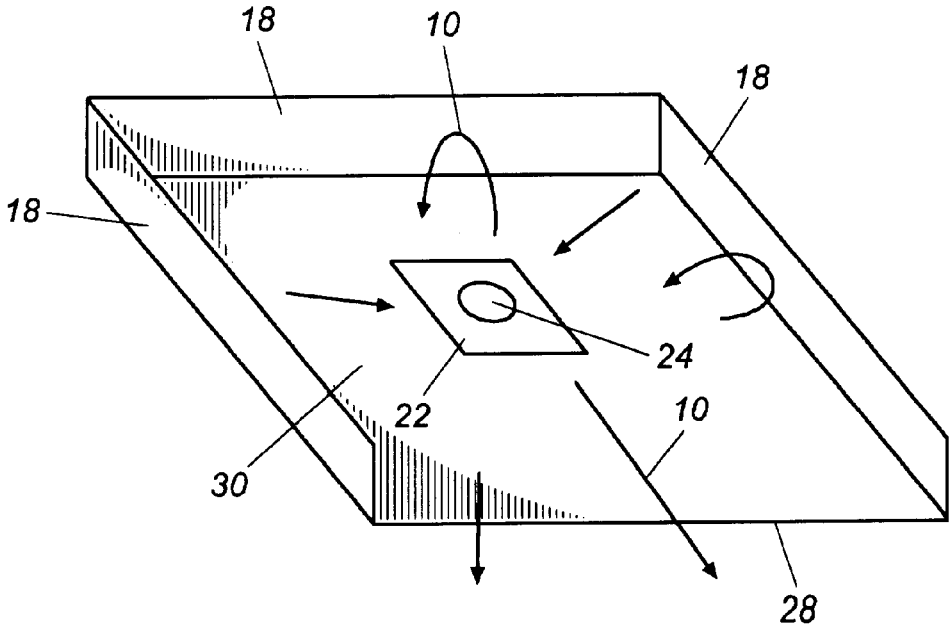
FIG. 2 shows the water flow in a traditionally configured shower base with a barrier-free entrance.

As shown in FIG. 2, when no front lip exists, water 10 spills outwardly onto the floor area adjoining front opening 28 of barrier-free shower base 30.

Figure 3:
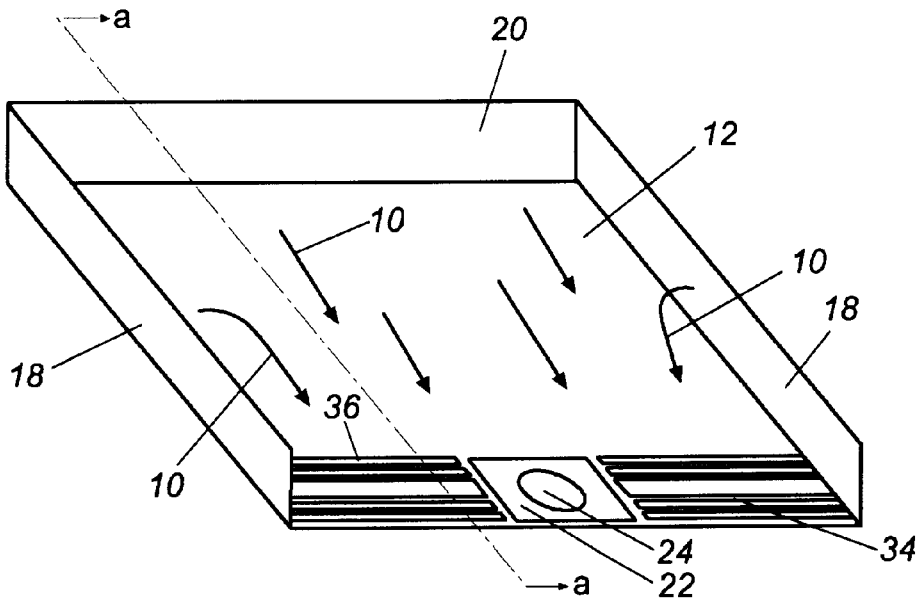
FIG. 3 shows the water flow in a barrier-free shower base with the configuration of the present invention.

FIG. 3 shows a first embodiment of a barrier-free shower base 30 having the configuration of the present invention. Drain 24 and drain sump 22 are positioned toward front opening 28 of barrier-free shower enclosure base 30. Barrier-free shower enclosure base 30 is preferably formed of a single sheet of fiberglass or acrylic material so that no joints or seams exist.

Figure 4:
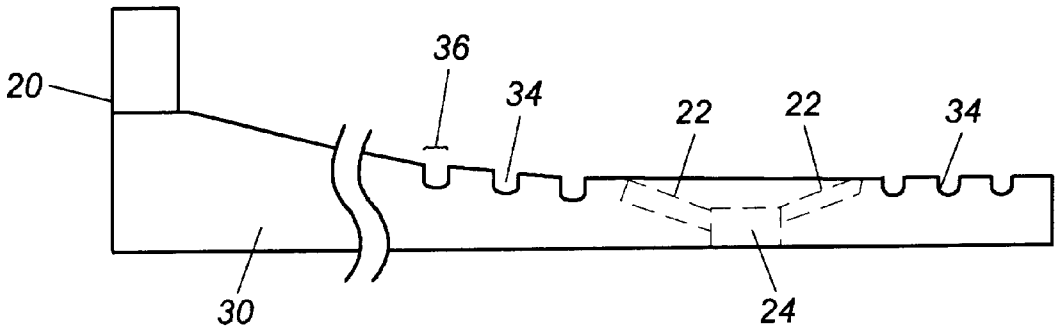
FIG. 4 shows a side view of the shower base of FIG. 3 taken along line a—a of FIG. 3.

FIG. 4 shows a side sectional view of barrier-free shower enclosure base 30 taken along line a—a of FIG. 3. This figure shows that floor 32 of barrier-free shower base 26 is, on all sides, angled so that drain sump 22 and drain 24 are positioned lower than the sides of shower base 30 where those sides adjoin the walls of the shower enclosure. This angling, in addition to the channel and drain arrangement described above, serves to direct water toward drain sump 22 and drain 24.

Formed into barrier-free shower enclosure base 30 are channels 32, as shown in FIG. 4, the channels leading from the sides of the base and connecting with drain sump 22. Water exiting channels 34 are thus directed toward drain sump 22 and thence to drain 24. Channels 34 are so configured that they are shallower toward sides 18 of shower enclosure base 30 and deeper near drain sump 22 to aid in the flow of water toward drain 24. An example of this structure is demonstrated in FIGS. 6–10.

Top openings 36 to channels 34 should be sufficiently narrow to allow the wheels of a wheelchair to be easily moved across the top of the channels without entering the channels or getting stuck. The channels may have a cross-sectional dimension on a lower portion of the channels, near the bottom of the channels, which is greater than the spacing of the top opening. A greater, or increasing, cross-section on a lower portion of the channel will facilitate a larger volumetric flow of water, while providing a top opening which is both small enough to allow the wheelchair to traverse the device, and sufficiently large to allow water to enter the channels. As an alternative, a grate system could be used. A top grate allows water to access a single larger channel, or multiple channels positioned below the grate. The openings to the grate are sufficiently large to allow water to enter the channel which is below the top grate. In any configuration or alternative, the channel or channels, are of increasing depth and slope toward the drain area and drain to facilitate the flow of water into the drain.

Figure 5:
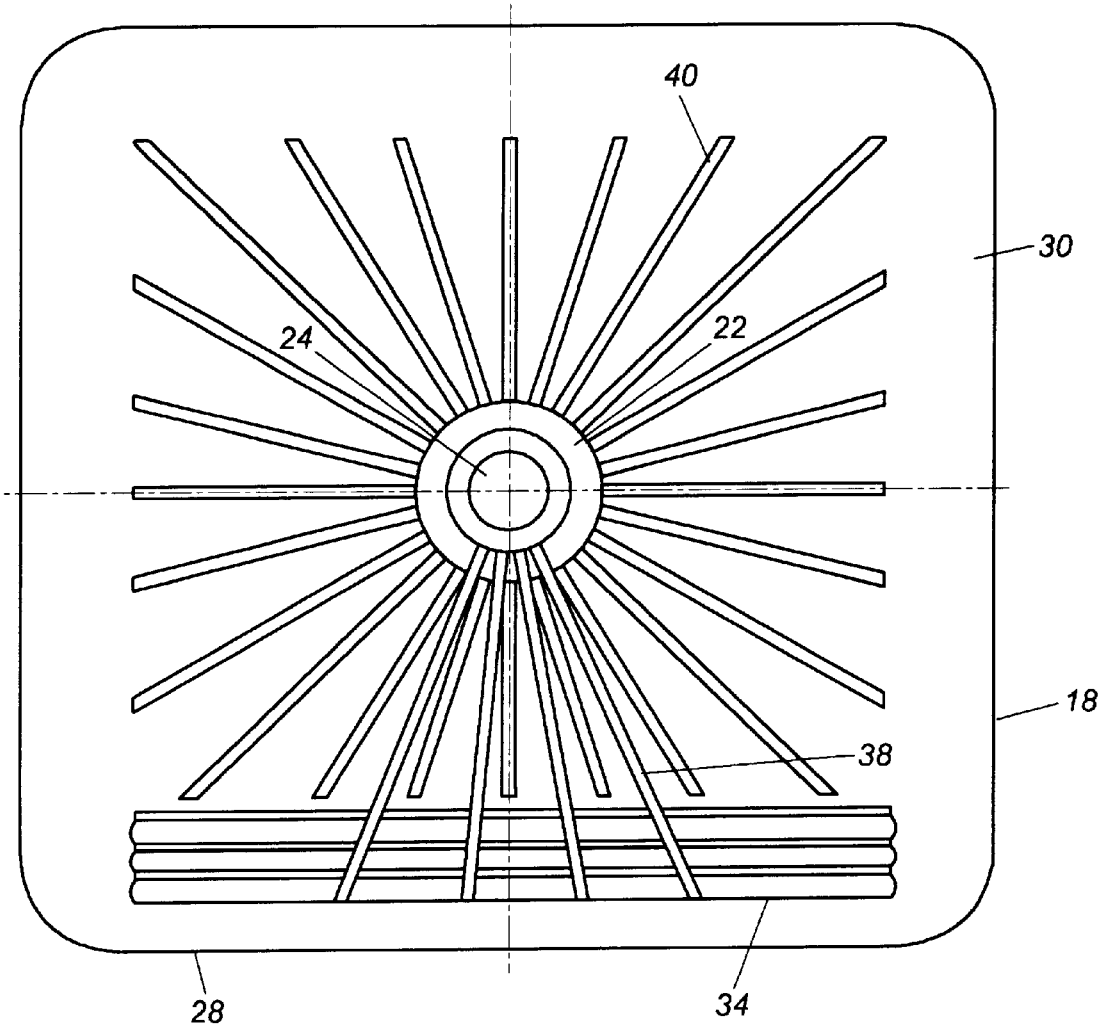
FIG. 5 shows another embodiment of the shower base of the present invention.
Figure 6:
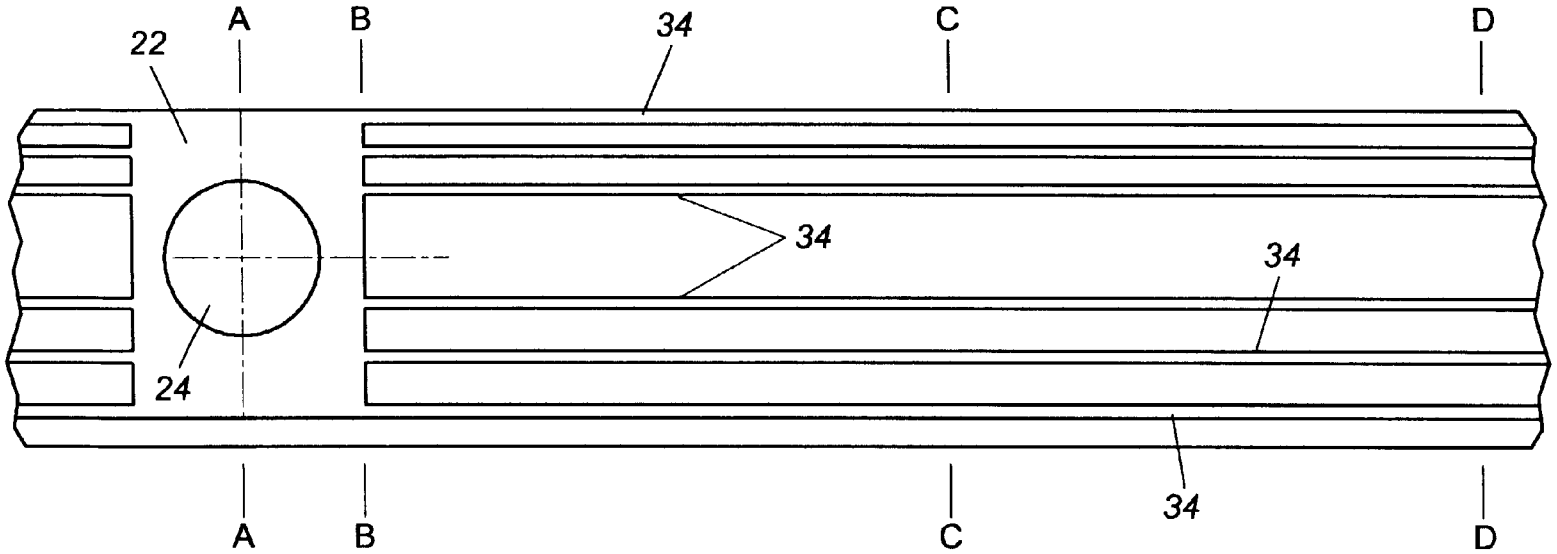
FIG. 6 is an enlarged top plan view of a portion of the base showing the channels, drain and the drain sump.
Figure 7:
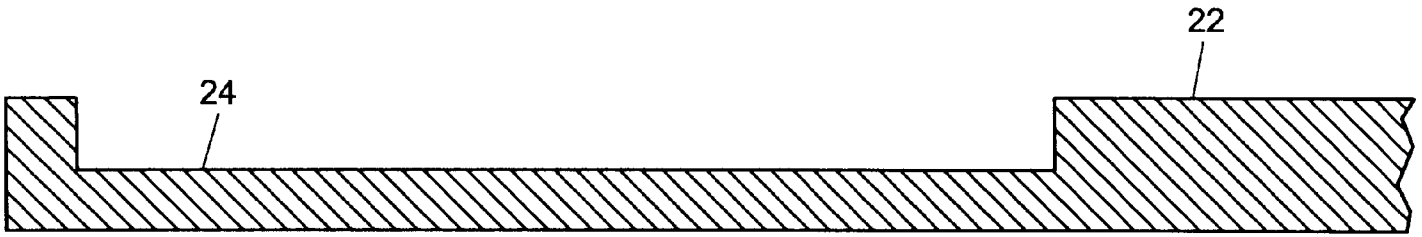
FIG. 7 is sectioned view taken essentially along line A—A of FIG. 6.
Figure 8:
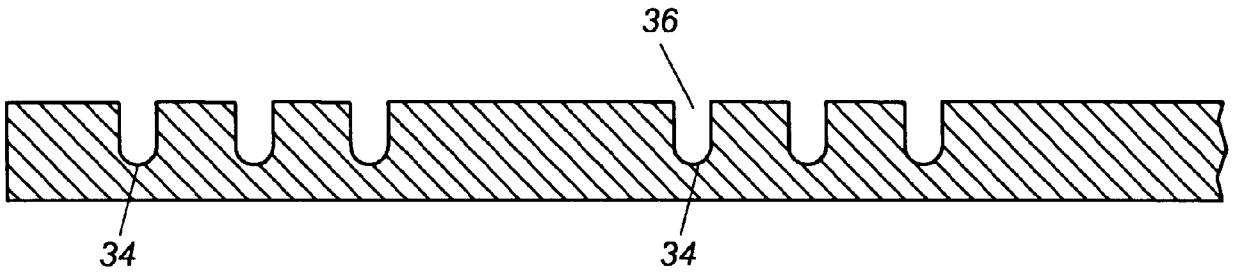
FIG. 8 is a sectioned view taken essentially along line B—B of FIG. 6.
Figure 9:
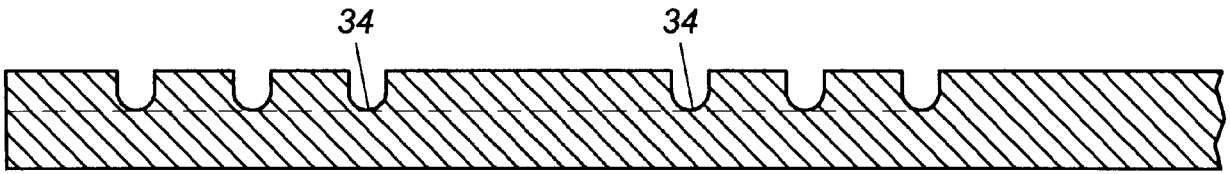
FIG. 9 is a sectioned view taken essentially along line C—C of FIG. 6.
Figure 10:
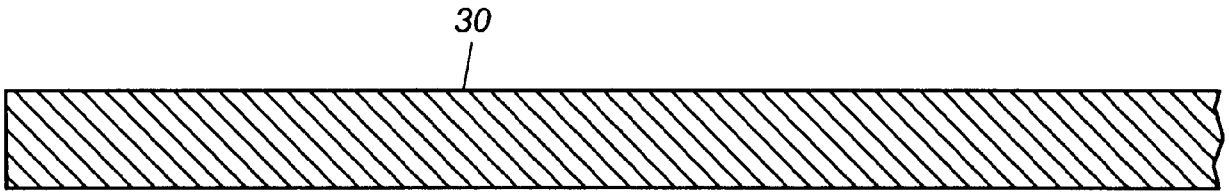
FIG. 10 is a sectioned view taken essentially along line D—D of FIG. 6.

As shown in FIG. 5, a differently configured arrangement of channels, drain sump and drain may be used. In this configuration, drain sump 22 and drain 24 are generally centrally located, as are most shower drains used in the prior art. Radial channels 38 connect with, and radiate outwardly from, drain sump 22 and drain 24. The sloping of the floor of base 30 is toward the drain. The radial channels slope from parallel channels 34 toward radial channels 38. The radial channels may increase in depth from the parallel channels to the drain.

As in the previous embodiment, the parallel channels 34 are positioned adjacent to the opening side of the barrier free shower. The structure of the channels is generally the same as the same as in the previous embodiment, except that the presence of a drain is optional, since the radial channels communicate with the parallel channels to transport water to the center drain as shown in FIG. 5. The parallel channels slope from the outer edge toward the radial channels, and perhaps to the center, if desired. The parallel channels may increase in depth from the outside to the inside, and have an increased cross section on a lower portion, as discussed above. Raised ribs 40 may be used to provide friction on the base, without interfering with the travel of the wheel chair.

Other channel structures could be used which do not depart from the spirit of the invention, which includes a channel structure near the opening of the barrier free shower which communicates with the drain, but does not interfere with the movement of a wheel chair into the shower enclosure.

In use, an occupant is positioned by means of a wheelchair within the shower. The wheelchair is rolled over the channels which essentially form the threshold at the entry side of the barrier-free shower. A shower curtain is placed in position over, but within the entry side.

The preferred embodiment of the present invention comprises a shower curtain having a continuous, but flexible, weight formed into its lower edge. The upper edge of the curtain has a series of grommet holes for attaching shower hooks to the curtain and thus attaching it to a shower rod.

Figure 11:
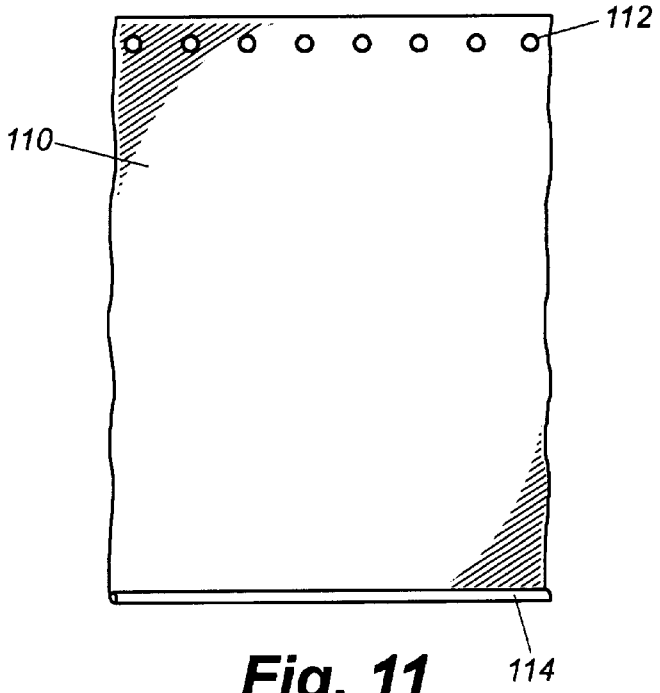
FIG. 11 is a front view of the shower curtain.

FIG. 11 is a front view of shower curtain 110 which is preferably made of vinyl treated with an anti-microbial substance. Grommet holes 112 are spaced across the top edge of shower curtain 110. A continuous, but flexible, weight 114 is incorporated into the bottom edge of shower curtain 110.

Figure 12:
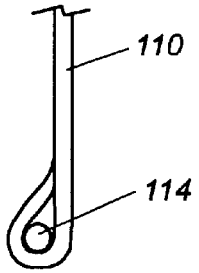
FIG. 12 is a detail of the bottom edge of the curtain, showing the weight inside the curtain.

FIG. 12 shows a partial edge-on side view of shower curtain 110, showing the way in which continuous weighing device 114 is incorporated into the bottom edge of shower curtain 110. Such incorporation may be by sewing or heat-sealing the vinyl material of which the shower curtain is made. Continuous, but flexible, weight 114 is preferably a length of stainless steel chain, but also may be any other type of flexible cable or weight-filled tube. The requirements are flexibility, and weight sufficient, but not excessive.

Figure 13:
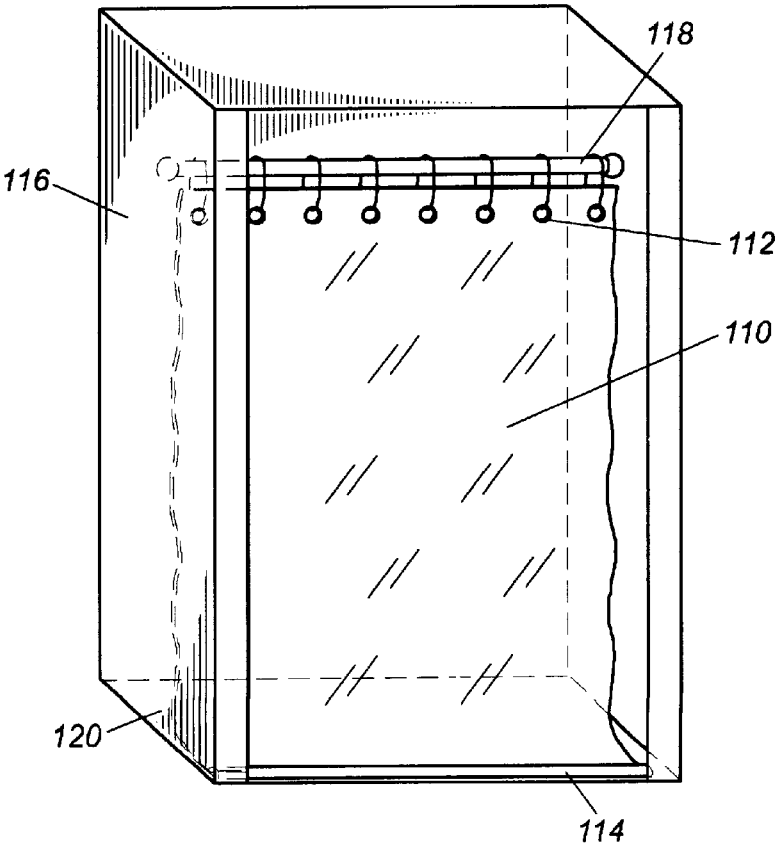
FIG. 13 is a perspective drawing showing the curtain inside a barrier-free shower enclosure having a drain system as disclosed herein.

FIG. 13 shows a perspective view of shower curtain 110 hanging inside shower enclosure 116. Shower curtain 110 is attached to top rod 118 of shower enclosure 116, and extends to base 120 of shower enclosure 116. Continuous weight 114 holds shower curtain 110 against shower enclosure base 120.

As can be seen in FIG. 13, there is no front barrier to the shower enclosure. The reason for such a configuration is to allow wheel chair access for handicapped, or otherwise mobility impaired individuals. The problem caused by this lack of a front barrier is that there is nothing against which a shower curtain can rest, or be held. Thus, the necessity of weighing the very bottom of the curtain. If the bottom of the curtain is weighted with discrete weights, the traditional approach, the curtain can pleat, or bend, between the weights, creating edges that may extend beyond the shower enclosure, allowing water bouncing from the sides and bottom of the shower enclosure to escape through the gaps caused by the openings, and then onto the floor adjoining the shower enclosure. However, with a continuous and flexible weight incorporated into the bottom edge of the shower curtain, and when the overall length of the curtain is sufficient not only to extend from the top of the shower enclosure to its base, but also a small amount, on the order of 1" to 3", of extra length, the weighted shower curtain will wrap around minor irregularities such as a protruding wheel chair handle or wheel, and still close off the bottom of the shower enclosure.

The bottom edge of the shower curtain is positioned over the channels 34 which are formed in the threshold of base 30, or at least toward the interior of the shower enclosure from the base. The bottom edge of the shower curtain is positioned just above, and generally parallel to the channels 34. The curtain, when spread to cover the opening of the shower enclosure as shown in FIG. 13, extends generally the length of the threshold.

What is claimed is:

1. A barrier free shower enclosure system having a barrier free threshold, comprising:

a. a base member having a barrier free threshold formed therein, said barrier free threshold extending along one side of said base member, said base member having a plurality of channels which are formed in said base member and immediately adjacent to barrier free threshold, each of said plurality of channels formed generally parallel to a front side of said barrier free threshold;

b. a drain sump which is formed in said base member; and c. a continuously weighted shower curtain, said continuously weighted shower curtain comprising a curtain having an upper portion and a lower portion, said upper portion of said curtain having therein a multiplicity of attachment devices, the lower portion having extending across substantially the entire width thereof, a weighting mechanism, said weighting mechanism comprising a continuous and flexible length of a weighting material sufficient to hold the curtain in a vertically extended position, and being of a length sufficient to extend substantially across the entire width of the lower portion of the curtain near a lower edge thereof, and wherein said lower portion of said curtain is positioned generally parallel to and above said barrier free threshold.

2. A barrier free shower enclosure system having a barrier free threshold as described in claim 1, wherein said drain sump is formed adjacent to said barrier free threshold, and wherein a first plurality of channels is formed in said base member adjacent to said barrier free threshold and generally parallel to a front of said barrier free threshold, and said first plurality of channels is present on one side of said drain sump and each of said first plurality of channels intersects said drain sump, and a second plurality of channels is formed adjacent to said barrier free threshold and generally parallel to a front of said barrier free threshold, and said second plurality of channels is present on an opposite side of said drain sump and each of said second plurality of channels intersects said drain sump.

3. A barrier free shower enclosure system having a barrier free threshold as described in claim 2, wherein each of said first plurality of channels increases in depth along a length thereof from a first end thereof and toward said drain sump.

4. A barrier free shower enclosure system having a barrier free threshold as described in claim 1, wherein each of said plurality of channels increases in depth from a first end thereof toward a center thereof, and each of said plurality of channels increases in depth from a second end thereof toward a center thereof.

5. A barrier free shower enclosure system having a barrier free threshold as described in claim 1, wherein said drain sump is formed in a location in said base member which is remote from said barrier free threshold, and wherein said base member has a second plurality of channels formed therein, wherein said second plurality of channels intersects said drain sump at one end of said second plurality of channels, and intersects said plurality of channels at an opposite end of said second plurality of channels.

6. A barrier free shower enclosure system having a barrier free threshold as described in claim 5, wherein said wherein said second plurality of channels each extends radially from and intersects said drain sump at one end of said second plurality of channels, and each of said second plurality of channels intersects said plurality of channels at an opposite end of said second plurality of channels.

7. A barrier free shower enclosure system having a barrier free threshold, comprising:

a. base member having a barrier free threshold formed therein and which extends along one side thereof, said base member having a plurality of channels which are formed in said base member immediately adjacent to said barrier free threshold, each of said plurality of channels formed generally parallel to another of said plurality of channels;

b. a drain sump which is formed in said base member; and c. a continuously weighted shower curtain, said continuously weighted shower curtain comprising a curtain having an upper portion and a lower portion, said upper portion of said curtain having therein a multiplicity of attachment devices, the lower portion having extending across substantially the entire width thereof, a weighting mechanism, said weighting mechanism comprising a continuous and flexible length of a weighting material sufficient to hold the curtain in a vertically extended position, and being of a length sufficient to extend substantially across the entire width of the lower portion of the curtain near a lower edge thereof, and wherein said lower portion of said curtain is positioned generally parallel to and above said barrier free threshold.

8. A barrier free shower enclosure system having a barrier free threshold as described in claim 7 wherein said drain sump is formed in said barrier free threshold, and wherein a first plurality of channels is formed in said base member and adjacent to said barrier free threshold, wherein each of said first plurality of channels is generally parallel to another of said first plurality of channels, and said first plurality of channels is present on one side of said drain sump and intersect said drain sump, and a second plurality of channels is formed in said base member and adjacent to said barrier free threshold, wherein each of said second plurality of channels is generally parallel to another of said second plurality of channels, and said second plurality of channels is present on an opposite side of said drain sump and intersect said drain sump.

9. A barrier free shower enclosure system having a barrier free threshold as described in claim 8, wherein each of said first plurality of channels increases in depth along a length thereof from a first end thereof and toward said drain sump.

10. A barrier free shower enclosure system having a barrier free threshold as described in claim 7, wherein each of said plurality of channels increases in depth from a first end thereof toward a center thereof, and each of said plurality of channels increases in depth from a second end thereof toward a center thereof.

11. A barrier free shower enclosure system having a barrier free threshold as described in claim 7, wherein said drain sump is formed in a location in said base member which is remote from said barrier free threshold, and wherein said base member has a second plurality of channels formed therein, wherein said second plurality of channels intersects said drain sump at one end of said second plurality of channels, and intersects said plurality of channels at an opposite end of said second plurality of channels.

12. A barrier free shower enclosure system having a barrier free threshold as described in claim 11, wherein said second plurality of channels extend radially from and intersect said drain sump at one end of said second plurality of channels, and intersects said plurality of channels at an opposite end of said second plurality of channels.

* * * * *